United States Patent [19]

Häfner

[11] Patent Number: 4,534,671

[45] Date of Patent: Aug. 13, 1985

[54] HOLDER WITH A STACK OF SHEETS

[76] Inventor: Rainer Häfner, Herrnstrasse 61 D-6050, Offenbach am Main, Fed. Rep. of Germany

[21] Appl. No.: 472,755

[22] Filed: Mar. 7, 1983

[30] Foreign Application Priority Data

Mar. 8, 1982 [DE] Fed. Rep. of Germany ..... 3208314

[51] Int. Cl.[3] ..... B42F 13/00; B42F 3/00; B42D 15/00

[52] U.S. Cl. ..... 402/80 R; 402/59; 283/76

[58] Field of Search ..... 402/59, 80 R, 80 P, 402/79; 411/155; 282/56

[56] References Cited

U.S. PATENT DOCUMENTS

| | | | |
|---|---|---|---|
| 451,710 | 5/1891 | Grunzweig | 402/59 |
| 958,008 | 5/1910 | Razall | 402/79 |
| 1,167,639 | 1/1916 | Eifel | 402/59 |
| 1,373,061 | 3/1921 | Kell et al. | 411/155 |
| 4,393,610 | 1/1981 | Adrian | 283/76 |

FOREIGN PATENT DOCUMENTS

| | | | |
|---|---|---|---|
| 541508 | 9/1959 | Fed. Rep. of Germany . | |
| 1263690 | 3/1968 | Fed. Rep. of Germany | 402/80 P |
| 2429358 | 6/1974 | Fed. Rep. of Germany . | |
| 3040280 | 6/1981 | Fed. Rep. of Germany | 402/80 R |
| 672555 | 12/1929 | France | 282/56 |

*Primary Examiner*—Paul A. Bell
*Assistant Examiner*—Paul M. Heyrana
*Attorney, Agent, or Firm*—Morse, Altman & Dacey

[57] ABSTRACT

A holder with a stack of sheets, each of which is provided with a hole through which a pin passes, the sheets being provided with a slot that extends from the hole to the edge of the sheet, and a cutout that is diametrically opposed to the slot. An annular part formed from a thin plate of stiff and, optionally, easily bent material is secured to the pin. This passes obliquely upwards through the slots and cutouts in the sheets and is arranged with about one half beneath the stack of sheets, the other half being above the stack (FIG. 4).

5 Claims, 4 Drawing Figures

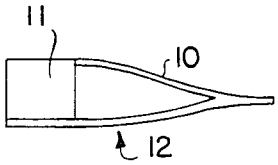
FIG. 1
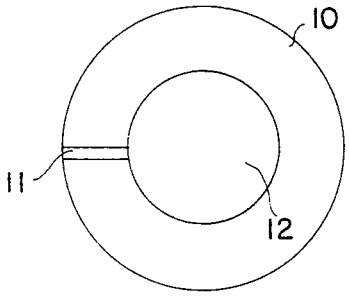
FIG. 2
FIG. 3
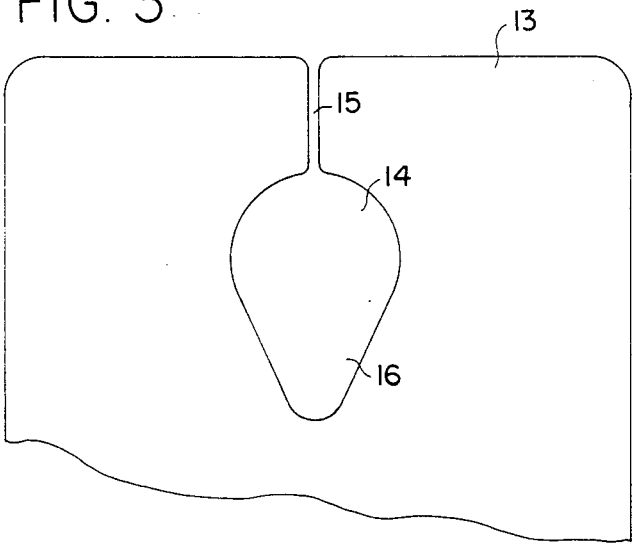

HOLDER WITH A STACK OF SHEETS

The invention relates to a holder with a stack of sheets, each of which is provided with a hole, a pin passing through the stack.

Various kinds of holders of sheets are known in the pertinent technology. There are, for example, clamp-type holders, the jaws (clamp portions) of which hold a stack of sheets above and below compressing the stack. Once the clamp has been opened it is possible to remove individual sheets.

In addition, holders for loose sheets are also known; these operate on the principle of already familiar files, in which each sheet is provided with a minimum of two holes, these being placed over pins, whereupon the upper ends of the pins are closed off by means of a bail.

Individual holders for stacks of sheets are also known wherein only a single hole is punched in each sheet. A sleeve having a collar or head portion is passed through the stack from one side and a threaded pin having a head portion is passed through the stack from the other direction, these two portions then being screwed into each other.

A holder of the type described in the introduction hereto is known (German petty patent No. 1 80 12 30); in this holder, a plurality of card-index cards is located between a base and a retaining knob, this retaining knob being secured to a tilting pin that is, for its part, secured to the base plate. In this known holder, the individual cards that make up the index can be removed from the stack and tilting the uppermost cards reveals the cards situated below.

In these known versions it is necessary to turn the sheets over, whereupon the cards are swung back into their original position by tilting them back.

Also known is a holder of the kind described above (German patent Offenlegungsschrift No. 30 40 280.3-27) which permits to read all of the sheets that make up the stack without turning over the sheets and without having to turn over leaves in order to do so. It is simply sufficient to turn a single sheet around a pin in order to bring it to a rear or lower position in the stack, so that the original sequence of the position of individual sheets is retained, without turning over a sheet. To this end, in the known holder, each sheet has a slot that extends from the edge of the sheet to the hole, and to one side of the slot there is provided a support for portions of the sheets, this being of a height that is at least equal to the height of the stack of sheets, a support extends beyond the center of the upper limiting part and a lower limiting part has a space for accommodating the portions of the sheets that are beneath the support and adjacent to the slot. In the known holder a plurality of individual parts is needed in order to ensure the desired function.

On the other hand, this invention has for its object to develop a holder of the above kind so that it consists only of a few parts and, additionally, it is desired to achieve that each sheet in a stack can be brought to the top of the stack without the need to remove the sheet from the stack.

This is accomplished by a holder of the type indicated at the beginning which is characterized by the fact that the sheets each have a slot that extends from the hole to the edge of the sheet, and a cutout that is diametrically opposed to the slot, and by the fact that secured to the pin there is an annular part configured from a thin plate of stiff and, optionally, easily bent material passing obliquely upwards through the slots and the cutouts in the sheets and arranged so that about one half is beneath the stack of sheets, the other half being above the stack.

The holder according to the invention requires only two parts, namely a pin that is preferably cylindrical, and a ring, the aperture of which can be installed over the pin. If the sheets have slots and cutouts that begin from the hole, and if the ring is mounted between the individual sheets of a stack in such a manner that half of the ring is beneath the stack and the other half is above the stack, then the individual sheets can be turned about the pin so that any desired sheet in the stack can be moved to the top. No components other than the ring and the pin are required.

In a preferred embodiment of the invention the ring does not merely consist of a disk-like, flexible part; rather, it is produced from such a ring and separated in a radial direction. A plate-like rigid portion is inserted between the combining portions and this is substantially of the same height as the planned stack of sheets. The use of such a ring ensures better guiding of the sheets during the rotation or turning process. The production process described above serves primarily to describe the configuration of the ring; it lies within the context of this invention that this part be produced as one piece of the appropriate shape by a plastic injection process.

In the holder according to the invention the ring and the pin can be joined to each other by a press fit or a clamp fit. In this way, there is achieved a solid joint between these components, so that on being turned about the pin the sheets can perform the proper turning and lifting movements.

The holder according to the invention can also be provided with a front and rear cover; thus, the "mechanism" of the holder can be covered. Such cover can have an annular cutout so that the pin can be inserted into this cutout, and it can also be configured so as to have an interrupted surface.

In the following, the invention will be explained by way of example by reference to the drawing:

FIG. 1 is a front elevation of a ring portion of a holder according to the invention.

FIG. 2 is a plan view of the ring portion shown in FIG. 1.

FIG. 3 is a portion of a sheet for a holder according to the invention.

Figure 4:
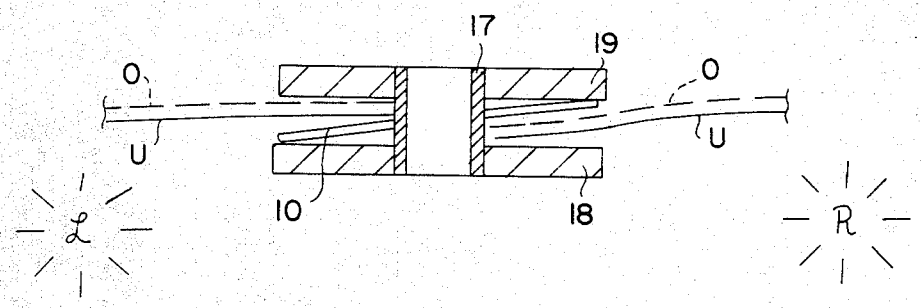
FIG. 4 is a cross-section view through a holder according to the invention.

In FIGS. 1 and 2, 10 indicates an annular part of a holder according to this invention. This part can be of plastic that is of a specific inherent stiffness but which can be bent. At one point the ring is separated and a sheet-like rigid plastic part 11 is inserted between the two ends of the ring that are axially separated. Accordingly, in the view according to FIG. 1, a portion of the ring 10 is located behind the part 11 and is of decreasing height whereas the portion of the ring in front of the part 11 is of further decreasing height and is finally connected to this at the lower level of the part 11. The opening in the ring is numbered 12 in the drawings.

FIG. 3 shows a sheet 13 that has a hole 14 that is substantially circular. In the upper part of the sheet 13 there is a slot 15 that connects the hole 14 to the outer edge. The lower part of the hole 14 has a cutout 16 that is diametrically opposed to the slot 15 and extends—more or less—evenly from the hole 14.

According to the invention the ring 10 is positioned between the sheets 13 of a stack in such a way that the part 11 is located in the area of the cutout 16. The diametrically opposed portion of the ring 10 is positioned in the area of the slot 15 so that, for example, the left-hand portion of the ring 10 is above the sheet 13, whereas the right-hand portion of the ring 10 is located beneath the sheet 13.

FIG. 4 shows a version of the holder according to the invention that has a front cover portion 18 and a rear cover portion 19. These parts are not in and of themselves essential, since they play only a subordinate role in the operation of the holder according to the invention.

FIG. 4 shows a holder according to the invention that has a cylindrical part 17 of hard plastic. This part is configured as a tube, and a ring 10 of the type described in FIGS. 1 and 2 is set on the outer circumference of the tube. The ring 10 is fast in the position shown, on the pin 17; it might be fixed to the pin 17 by glue or cement, but only after having been placed in position between the sheets of the stack in the manner described.

FIG. 4 shows two sheets, the upper identified with the letter o and the lower with the letter u. For purposes of the description that follows, the left-hand side of the holder is identified with a capital L, and the right-hand side with a capital R.

If one views the holder according to the invention from above, as is shown in FIG. 4, the upper sheet o is above the lower sheet u. If, however, the upper sheet o is rotated from left to right, it is clear that once having been rotated through 360 degrees the upper sheet o is now beneath the lower sheet u, because the ring 10 with its oblique position and its arrangement in the slots 15 and the cutouts 16 ensures that the upper sheet slides under the lower sheet.

I claim:

1. A holder comprising a pin and annular member with a stack of sheets (13), each of said sheets being provided with a circular hole (14), a slot (15) extending from said hole (14) to an edge of said sheet, and a V-shaped cutout (16) communicating with said hole and being diametrically opposed to said slot (15), an annular flexible member (10) passing obliquely upwards through said slot (15) and said cutout (16) in said sheets (13), said annular member (10) arranged so that approximately one half thereof is below said stack of sheets and the other half above it.

2. A holder according to claim 1, characterized by said flexible annular member (10) being constituted of an annular portion that is cut radially, and of a rigid portion (11) that is inserted axially at said radial cut.

3. A holder according to claim 2, characterized by said flexible annular member (10) being injection molded from plastic as one piece.

4. A holder according to any one of claims 1 to 3, characterized by the fact that the pin (17) and the annular part (10) are connected to each other by a press or clamp fit.

5. A holder according to claim 1, characterized by the fact that the pin (17) is provided with a front and/or rear cover portion (18, 19).

* * * * *